US006591823B1

(12) United States Patent
Keller

(10) Patent No.: US 6,591,823 B1
(45) Date of Patent: Jul. 15, 2003

(54) ARROW GUIDE AND HOLDER WITH CAM-LIKE ACTION

(75) Inventor: Charles R. Keller, Grovetown, GA (US)

(73) Assignee: Keller Manufacturing, Inc., Grovetown, GA (US)

( * ) Notice: Subject to any disclaimer, the term of this patent is extended or adjusted under 35 U.S.C. 154(b) by 0 days.

(21) Appl. No.: 10/119,928

(22) Filed: Apr. 10, 2002

Related U.S. Application Data

(60) Provisional application No. 60/308,420, filed on Jul. 27, 2001.

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | |
|---|---|---|---|---|
| 3,828,757 A | | 8/1974 | Finlay | |
| 3,935,854 A | | 2/1976 | Troncosco, Jr. | |
| 4,133,334 A | | 1/1979 | Tone | |
| 4,318,390 A | | 3/1982 | Trotter | |
| 4,473,058 A | | 9/1984 | Terry | |
| 4,686,956 A | | 8/1987 | Troncoso, Jr. | |
| 4,809,669 A | | 3/1989 | Saunders | |
| 4,838,237 A | | 6/1989 | Cliburn | |
| 4,924,841 A | | 5/1990 | Smith | |
| 4,947,823 A | | 8/1990 | Larson | |
| 4,949,699 A | * | 8/1990 | Gerber | 124/44.5 |
| 5,052,364 A | * | 10/1991 | Martin et al. | 124/44.5 |
| 5,070,855 A | | 12/1991 | Troncoso | |
| 5,137,006 A | | 8/1992 | Gallops | |
| 5,285,764 A | | 2/1994 | Mertens | |
| 5,383,441 A | | 1/1995 | Lightcap, Jr. | |
| 5,421,314 A | | 6/1995 | Kidney | |
| 5,476,086 A | | 12/1995 | Smith | |
| 5,555,875 A | | 9/1996 | Martin et al. | |

* cited by examiner

*Primary Examiner*—John A. Ricci
(74) *Attorney, Agent, or Firm*—Maria Reichmanis

(57) ABSTRACT

An arrow guide and holder including a body having a pair of crossed, offset bores formed therethrough, a flexible, resilient, bendable arm installed in each bore so that the forward ends of the arms extend forwards of the body and the rearward ends extend rearwards of the body, and a coil spring connected between the rearward ends to bias the arms towards a rest position. The arms are complementary in shape for gripping the shaft of an arrow therebetween, and are movable from the rest position to permit free passage of the arrow fletching therethrough. The forward ends or the rearward ends of the arms, or both, may be at least partly covered by jackets.

20 Claims, 4 Drawing Sheets

ARROW GUIDE AND HOLDER WITH CAM-LIKE ACTION

This application claims benefit of provisional application Ser. No. 60/308,420 filed Jul. 27, 2001.

BACKGROUND OF THE INVENTION

1. Field of the Invention

The present invention relates generally to devices mounted to archery bows for the purpose of guiding an arrow as it is drawn and released. In particular, the present invention relates to an adjustable, spring-biased arrow guide and holder for use with a bow.

2. Discussion of Background

Increasing numbers of sportsmen are discovering that archery offers unique challenges over other forms of outdoor activity. In order to shoot an arrow from a bow, its rear or nock end is nocked on the bowstring, and its shaft is placed on a ledge or other support on the bow. The archer then draws the bowstring (which is attached to the limb tips of the bow) backwards towards himself with one hand while he holds the bow at arm's length with his other hand. When the bowstring is fully drawn back, the archer aims the arrow and releases the bowstring. The bent bow limbs force the released bowstring and arrow forwards; when the bowstring reaches its forward limit of movement (constrained by the limbs), the arrow accelerates forwards. When an archer shoots an arrow, the propulsive force exerted by the bowstring accelerates the arrow from a resting state to a velocity that may be as high as several hundred feet per second. In addition to this almost instantaneous propulsive force, the archer's act of releasing the bowstring tends to impart a sideways torque to the arrow, causing the arrow to undergo a series of bowing and flexing motions which affect the direction of flight. This tendency is aggravated for modern compound bows, which are capable of releasing arrows at much greater velocities than traditional bows: the greater the arrow velocity, the greater the degree of bowing and flexing, and the greater the difficulty in shooting arrows accurately and consistently.

Whether they use their bows for hunting, competition shooting, or recreational shooting, most archers use devices known variously as arrow guides, arrow holders, arrow rests, or arrow supports to help improve the accuracy of their aim (for purposes of this specification, these terms are used interchangeably). An arrow guide is attached to a bow in a position where it can support an arrow as the arrow is drawn, and also to guide the arrow's flight as it is released. (Most modern bows have suitably-positioned holes for use in mounting arrow guides.) A properly-designed arrow guide can help an archer to aim and accurately shoot an arrow by absorbing some of the forces that cause bowing and flexing. Ideally, an arrow guide can be adjusted for different types of shooting conditions, target distances, or types of arrow. For example, an archer might prefer a particular type of arrow for target practice, another type of arrow for competition shooting under controlled conditions, and still another type of arrow for hunting.

Many different types of arrow guides are available to consumers. Many of these permit some degree of vertical and horizontal adjustment so that the archer can adapt the arrow guide to different conditions, target distances, and types of arrow. Some arrow guides include a pair of spaced-apart coplanar arms (also termed "fingers" or "blades") that are adjustable with respect to the bow. Martin, et al. (U.S. Pat. No. 5,555,875) shows this type of device, which includes a handle riser with a primary shelf portion, a movable shelf extension portion, and a spring-loaded arrow rest assembly with two outwardly-projecting arms coupled to the movable shelf extension. The shelf extension allows the user to adjust the arrow rest assembly between a normal position and a maximum overdraw position.

Smith (U.S. Pat. No. 5,476,086) provides a micro adjust arrow rest with a mounting bracket, a U-shaped carriage, a launcher body with two coplanar arms (termed "launcher fingers"), and a threaded pin for lateral adjustments. Kidney (U.S. Pat. No. 5,421,314) shows an arrow support with two fingers made of spring steel. The gap between the fingers is adjusted so as to be slightly smaller than the diameter of an arrow. Lightcap, Jr. (U.S. Pat. No. 5,383,441) shows an adjustable arrow rest with a mounting bracket, a pair of coplanar arms, and a small torsion spring. The Mertens (U.S. Pat. No. 5,285,764) arrow rest apparatus has wire launching fingers attached to a rotatable collar.

Gallops (U.S. Pat. No. 5,137,006) describes an arrow rest with an arm that is adjustably mounted to the bow handle and a vertically depressable arrow support connected to the arm. The support, which can be moved to and from the arm via a shuttle assembly, includes a pair of coplanar, adjustable-length arms. Troncoso (U.S. Pat. No. 5,070,855) shows an adjustable arrow rest where a pair of blades are biased into the desired position by a coiled spring. His device can be provided in the form of a kit for use with any arrow rest having a suitable cross-bar and mounting block.

Cliburn's arrow rest has two independently-pivotable blocks, each of which holds a spring-loaded finger (U.S. Pat. No. 4,838,237). The fingers can be deflected by a moving arrow. Trotter (U.S. Pat. No. 4,318,390) describes an arrow retainer with a pair of coplanar, spring-loaded retaining arms fitted with pads. Troncoso, Jr. (U.S. Pat. No. 4,686,956) shows a spring-loaded arrow rest with a pair of coplanar, bendable wire arms. If the arms are bent so that they grip the shaft above its mid-line, the bow can be inverted without losing the shaft. In U.S. Pat. No. 3,935,854, Troncoso, Jr. discloses an arrow support with a pair of spaced-apart arms made of steel or plastic wire. The lower ends of the arms are joined, and may be coiled to increase their springiness. The arms can be bent so as to position the shaft in the preferred position.

Arrow support structures that include springs, arms, and the like are also known in the art. For example, Larson (U.S. Pat. No. 4,947,823) shows an arrow rest consisting of a flexible wire with coil springs at either end; alternative embodiments include a pair of approximately coplanar arms. R. D. Smith (U.S. Pat. No. 4,924,841) discloses an arrow guide with a mounting plate and spring-biased rest lever. Saunders (U.S. Pat. No. 4,809,669) discloses a combination arrow rest and arrow shaft guide formed of spring wire. The shaft is held between two shaped ends which can be covered with low-friction sleeves.

Terry's arrow rest (U.S. Pat. No. 4,473,058) includes a pivotably-mounted wire that underlies and supports the shaft of the arrow; the wire is biased towards an extended position by a magnet. Tone (U.S. Pat. No. 4,133,334) shows a flipper type arrow rest with a closed loop spring having ends pivotally attached to the mounting plate. The spring supports a shaft in a predetermined position with respect to the bow, and retracts to permit passage of the fletching. Finlay's spring-biased arrow rest (U.S. Pat. No. 3,828,757) includes a movable support, and can be adjusted so that the arrow is at a predetermined distance from the side of the bow.

Presently-available arrow guides help improve an archer's accuracy in shooting arrows, but many of them have complex and delicate mechanisms that do not hold up well when subjected to the rigors of field use. Furthermore, many arrow guides are difficult to adjust to conform to an individual archer's strength, shooting style, and choice of bow and arrows; some arrow guides cannot be adjusted at all. Despite the many different types of arrow guides that are available to archers, there is a remaining need for a simple, adjustable, easy-to-use arrow guide that assists an archer to shoot accurately and consistently.

SUMMARY OF THE INVENTION

According to its major aspects and broadly stated, the present invention is an arrow guide and holder, also termed herein an arrow rest, arrow support, or arrow holder. The invention includes a body having a pair of crossed, offset bores formed therethrough, a pair of flexible, resilient, bendable arms (one arm installed in each bore) so that the forward ends of the arms extend forwards of the body and the rearward ends extend rearwards of the body, and a coil spring connected between the rearward ends to bias the arms towards a rest position. The arms are complementary in shape, formed for gripping the shaft of an arrow therebetween, and are movable from the rest position to permit free passage of the arrow fletching therethrough. The forward ends or the rearward ends of the arms, or both, may be at least partly covered by jackets.

The arrow guide is installed on the handle of a bow for use. To shoot an arrow, the archer positions it so that the shaft is gripped by the forward ends of the arms, which are at or near the rest position. He then draws the bow, aims the arrow at a selected target, and releases the bowstring to accelerate the arrow forwards. The forwardly-moving fletching lightly engages the arms, urging them to open from the rest position and compressing the spring. After passage of the arrow, the spring recoils and returns the arms to their rest position, ready to receive another arrow. Passage of the fletching results in a form of cam action, that is, the transmission of motion to the forward and rearward ends of the arms. During use, the arms cooperate to help maintain the direction of the arrow, at least partly counteracting torques imparted by the archer during the act of releasing the bowstring. By reducing torque-induced bending and flexing of arrows, an arrow guide according to the invention improves shooting accuracy and consistency.

The body of the arrow guide is an important feature of the present invention. The body, which is attachable to the bow handle and which maintains the spring arms in position, has a pair of bores in an spaced-apart "X" configuration. That is, the bores are in approximately parallel planes, but are offset (horizontally or vertically, depending on the viewer's frame of reference) so that the arms do not intersect inside the body. The body is preferably made of rugged, durable materials such as brass, aluminum, or steel; however, other materials such as composites and engineering plastics may also be useful.

The complementary arms are another important feature of the present invention. Each arm is preferably made of a single piece of flexible, resilient, bendable wire, most preferably of metal although some plastics may also have the desired properties. The arms are complementary in shape, that is, approximately mirror images of each other, so as to support an arrow shaft therebetween regardless of the direction in which the bow is canted: the arms hold the arrow securely even when the bow is upside down. The arms move readily to allow the passage of the fletching when the arrow is shot by the archer, and do not release the arrow until the fletching has passed. The forward ends of the arms guide the arrow and the fletching to help maintain the arrow's direction, thereby canceling at least part of any torque-induced bending and flexing which reduces accuracy and consistency.

Still another feature of the present invention is its adjustability. The arms can readily be bent and/or tilted to accommodate different sizes of arrow shaft and differently-shaped fletching. Indeed, tilting the arms within a range of a few degrees or thereabouts is generally sufficient to accommodate arrow shafts ranging from about ¼" to about ½" in diameter. The arms can also be adjusted to suit the individual user. It should be understood that these types of adjustments are best made with a modest amount of experimentation for each individual.

Another feature of the present invention is the coil spring, which gently biases the arms towards their rest position yet readily compresses as the forward ends move apart during passage of an arrow. After the arrow is fully released, the spring recoils to return the arms to the rest position.

Other features and advantages of the present invention will be apparent to those skilled in the art from a careful reading of the Detailed Description of Preferred Embodiments presented below and accompanied by the drawings.

DETAILED DESCRIPTION OF PREFERRED EMBODIMENTS

Figure 1:
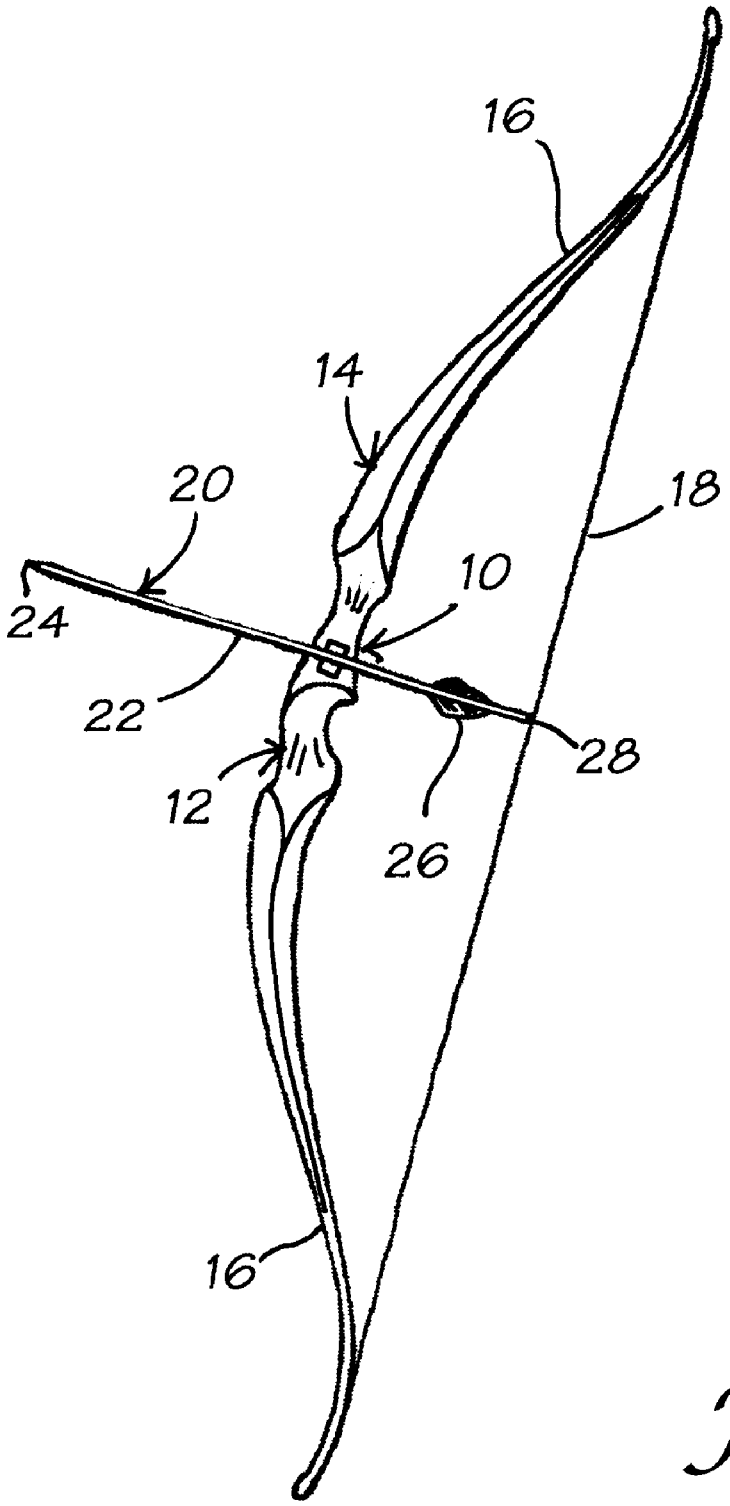
FIG. 1 is a side view of an arrow guide and holder device according to a preferred embodiment of the present invention, shown attached to the handle of a bow.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. §112. As used herein, the terms "horizontal," "vertical," "left," "right," "up," "down," as well as adjectival and adverbial derivatives thereof, refer to the relative orientation of the illustrated structure as the particular drawing figure faces the reader.

Referring now to FIGS. 1–5, there is shown an arrow guide and holder device 10 (hereafter, referred to as arrow guide 10) according to a preferred embodiment of the present invention. Arrow guide 10 is mounted to the handle or grip portion 12 of a bow 14 having limbs 16, strung with a bowstring 18. An arrow 20 having a shaft 22 with a forward end terminated by a tip 24, and a rearward end with fletching 26 and a nock 28 is positioned in device 10. It should be understood that bow 14 and arrow 20 are usable with the invention but do not form a part thereof, device 10 can be used with virtually any types of bow and arrow. The terms "fletching" or "fletch" usually refer to fletching made of feathers, while "vane" or "vanes" refer to plastic fletching; these terms are used interchangeably.

Figure 3:
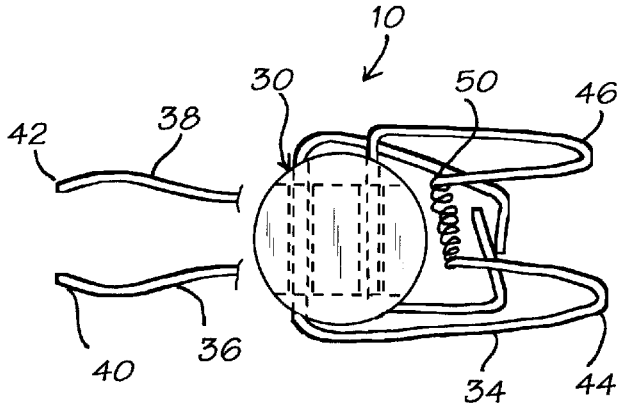
FIG. 3 is a top view of the device of FIG. 2A.

Arrow guide 10 includes a body 30 with two bores 32, 34 therethrough. Body 30 is secured to a first shaft $S_1$ which in turn is secured to a second shaft $S_2$ for attachment to a bow. Bores 32, 34 cross in an "X" configuration. However, bores 32, 34 are not coplanar but rather are offset from each other generally as shown in FIGS. 3–5. A pair of complementary, spaced-apart spring arms 36, 38 extend through bores 32, 34, one in each bore (for clarity, those portions of arms 36, 38 which are above body 30 in FIG. 3 are not shown). Forward ends 40, 42 of arms 36, 38, respectively, extend forwards of body 30, converging towards each other (the ends may be spaced apart when in the rest position shown in FIG. 4, or may just touch each other). Rearward ends 44, 46 extend rearwards of body 30, and like ends 40, 42, converge but need not touch.

Figure 2A:
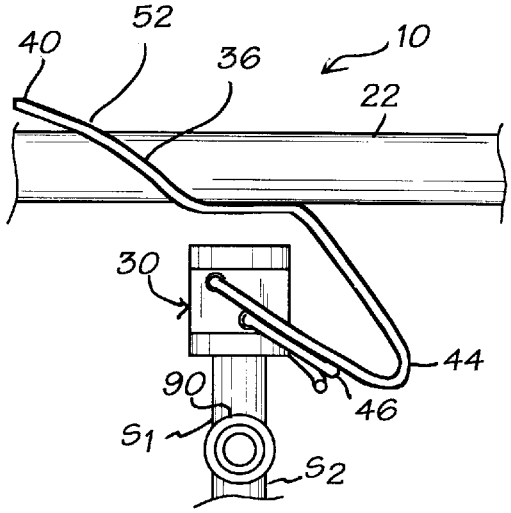
FIG. 2A is a left side view of the device of FIG. 1, showing one of the arms positioned against an arrow.
Figure 2B:
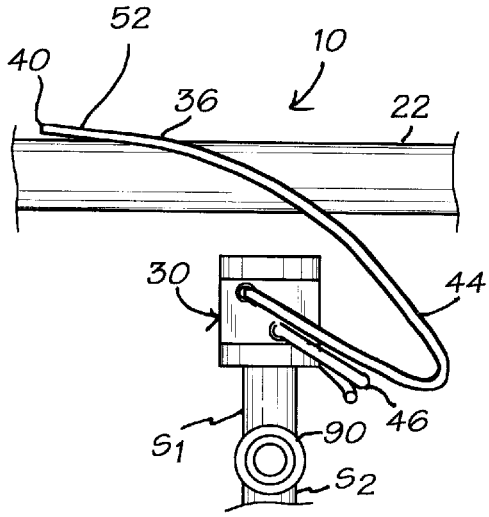
FIG. 2B is a left side view of an arrow guide and holder device according to another preferred embodiment of the present invention.
Figure 2C:
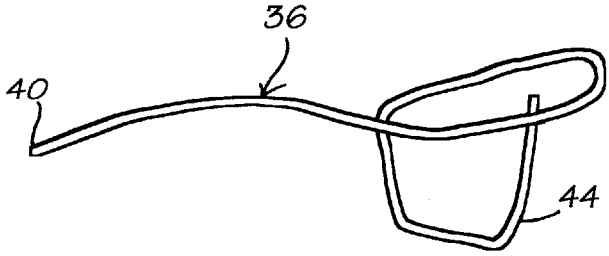
FIG. 2C is a left side view of the right arm of the device of FIG. 2B.

Arms 36, 38 may assume virtually any convenient shape for installation in bores 32, 34; forward ends 40, 42 are shaped for holding and guiding arrow 20 as will be described further below. Two such shapes as illustrated in FIGS. 2A and 2B; however, differently-shaped arms 36, 38 may also be useful. FIG. 2C shows a side view of arm 36 of FIG. 2B, arm 38 being bent in a similar fashion.

Arrow guide 10 may be attached directly to handle 12; alternatively, shaft $S_2$ may be attached to any suitable base, which in turn is secured to handle 12 by screws, nuts, or other suitable fasteners.

Figure 4A:
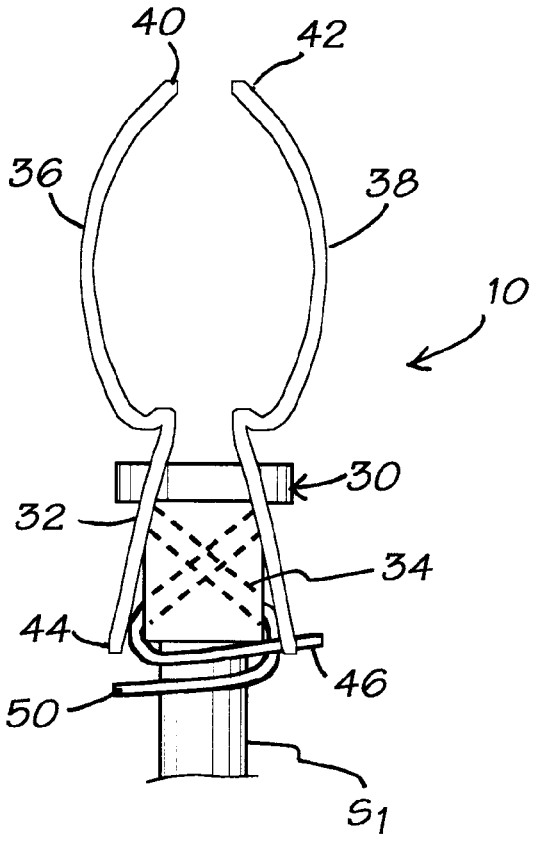
FIGS. 4A and 4B are rear views of the devices of FIGS. 2A and 2B, respectively.
Figure 4B:
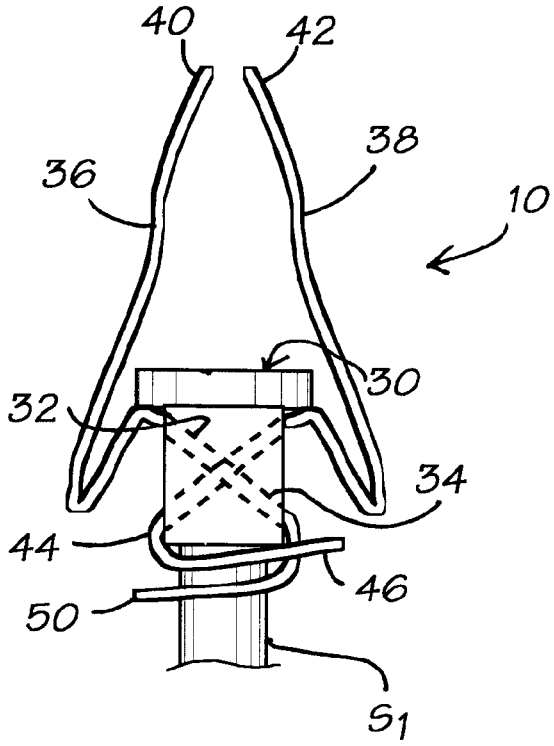
Figure 5:
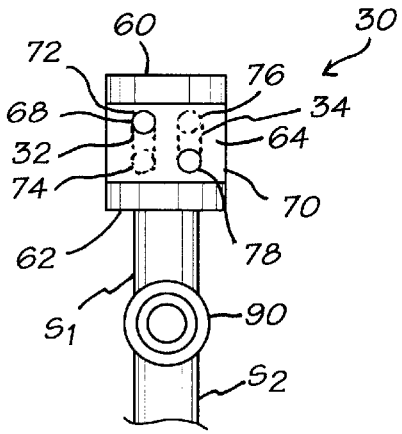
FIG. 5 is a left side view of the body.

A coil spring 50 is attached between rearward ends 44, 46 (FIGS. 3, 4A and 4B). Spring 50 biases forward ends 40, 42 of arms 36, 38 towards each other with a force that depends on the spring tension. The tension of spring 50 may be adjusted to suit the individual archer's preferences for various shooting conditions: different tensions may be used for different types of arrows, target distances, and so forth. The optimum tension of spring 50 also depends on the dimensions and materials of body 30 and arms 36, 38. FIGS. 4A and 4B show two embodiments of arms 36, 38; however, as noted above, differently-shaped arms 36, 38 may also be useful.

If desired, at least a portion of each of ends 40, 42 and/or 44, 46 may be covered by a jacket or sleeve (FIG. 2A shows arm 36 fitted with a jacket 52). If present, the jackets serve a dual purpose: they help protect the exposed portions of arms 36, 38, and also act as retainers to retain the arms in body 30. Such jackets may be of any suitable material, for example, fabric or plastic tape, vinyl or plastic tubing, heat-shrink tubing, and so forth.

The optimum dimensions of body 30 depend on factors such as the sizes, configurations, and weights of the bows and arrows with which arrow guide 10 is used. Typically, a body 30 that measures no more than approximately ¼"–½" (about 0.64–1.27 cm) in diameter can be used with all or most presently-available bows. Arrow guide 10 with body 30 may be dimensioned for use with bows that have standard-sized mounting holes for arrow guides. Arms 36, 38 may be approximately 1/32"–1/16" (about 0.08–0.16 cm) in diameter; however, arms of different diameters may also be useful. Bores 32, 34 preferably have somewhat larger diameters than arms 36, 38 in order to allow for some play of each arm in its respective bore. As will be evident, the optimum dimensions of body 30 are best determined by a modest amount of experimentation and observation for each particular application.

As noted above, arms 36, 38 are offset from each other in bores 32, 34, respectively. Bores 32, 34 are not coplanar, rather, the bores are configured as shown in FIGS. 3–5. That is, body 30 has a top 60, a bottom 62, a right side 64, a left side 66, a forward end 68, and a rearward end 70 (FIG. 5). The offset and cross action of arms 36, 38 is provided by bores 32, 34: bore 32 extends from an opening 72 at top 60 near forward end 68 of side 64 to an opening 74 at bottom 62 of side 66. Similarly, bore 34 extends from an opening 76 at top 60 near rearward end 70 of side 66 to an opening 78 at bottom 62 of side 64. (The term "near" as used herein means that an opening 72, 74, 76, 78 is closer to one of ends 68, 70 than it is to the other end.)

Arms 36, 38 are complementary in shape to facilitate gripping the shaft of an arrow; forward ends 40, 42 converge but are generally spaced somewhat apart from each other to permit shaft 22 to pass therebetween. Alternatively, forward ends 40, 42 may just touch each other when arrow guide 10 is in the rest position. Furthermore, arms 36, 38 are movable to permit free passage of fletching 26. While other configurations are within the scope of the invention, arms 36, 38 are preferably approximately mirror images of each other when installed in body 30.

Body 30 is made of brass, aluminum, steel, titanium, or other suitable material. Metal and metal alloys are preferred due to their durability and ruggedness; however, sturdy composite materials and engineering plastics may also be useful. If desired, body 30 may be plated with any suitable metal or alloy. Spring 50 is preferably made of spring steel.

Each of arms 36, 38 is formed of a single piece of high tensile strength, resilient, flexible and bendable wire, for example, steel or titanium wire. However, any material with the desired springiness and resiliency may be used. Preferably, arms 36, 38 have sufficient strength to support the load of an arrow shaft without bending or buckling, and sufficient resiliency and flexibility to be easily displaced in any direction, but return to an original position when released. Metal wire with these properties is readily available; however, engineering plastics and elastomeric materials with these properties may also be suitable. Arms 36, 38 can be bent at any selected locations; in addition, forward ends 40, 42 and rearward ends 44, 46 can be bent towards and away from each other. The arms can also be rotated to help accommodate arrow shafts of differing diameters: as little as 1°–2° may be sufficient, depending on the diameter of the selected shaft. These adjustments allow the user to adjust arms 36, 38 to position shaft 22 of the selected arrow vertically, and also to adjust the spacing of ends 40, 42, 44, 46 depending on the diameter of the shaft. In addition, set screw 90 (FIGS. 2A and 2B) permits vertical adjustment of body 30 on shaft $S_1$.

To use arrow guide 10, the archer selects an arrow 20 and positions the arrow so that shaft 22 is approximately parallel to body 30 and nock 28 is nocked on bowstring 18. Forward ends 40, 42 of arms 36, 38 grasp shaft 22 and help maintain the alignment of arrow 20 with respect to handle 12 no matter which way bow 14 is pointed ("canted"). When ready, the archer draws bowstring 18 backwards, aims arrow 20 at the target, and releases the bowstring. The bent bow limbs 16 force bowstring 18 and arrow 20 forwards, and, when the bowstring reaches its forward limit of motion, the arrow continues moving forwards.

Figure 6:
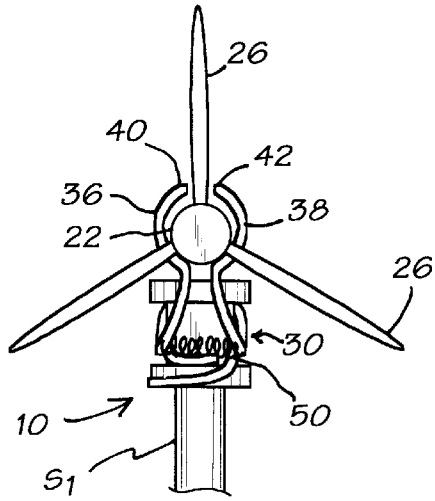
FIGS. 6 and 7 are rear views showing the arms of the device of FIG. 2A in the closed and open positions, respectively.
Figure 7:
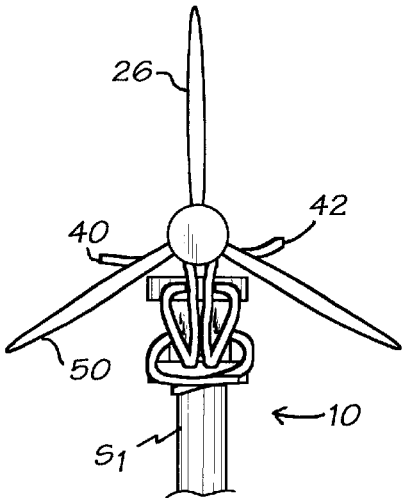
Figure 8:
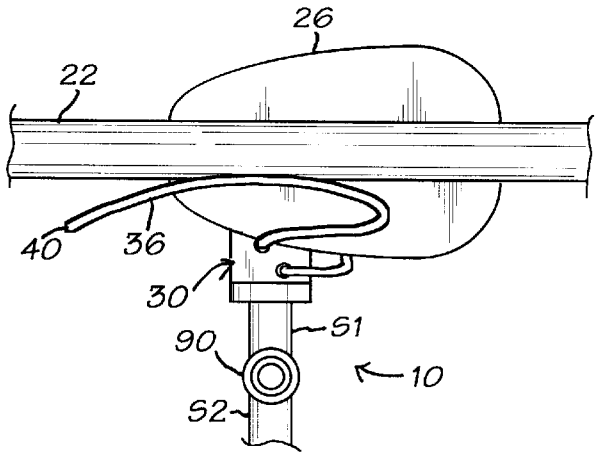
FIG. 8 is a left side view of the device of FIG. 2B, showing passage of the fletching therethrough.

When arrow 20 is ready, shaft 22 and fletching 26 are approximately as shown in FIGS. 2A, 2B, and 6. Spring 50 is typically at least somewhat compressed, urging forward ends 40, 42 of arms 36, 38 together to hold the arrow in position regardless of which way the bow is canted. As fletching 26 passes through arms 36, 38, the fletching lightly engages the arms, urging forward ends 40 and 42 apart from the closed position shown in FIG. 6 to the open position of FIGS. 7 and 8. As forward ends 40, 42 move apart, rearward ends 44, 46 move towards each other, compressing spring 50, which thus absorbs at least some of the force exerted by fletching 26 engaging arms 36, 38. Arms 36, 38 also help maintain the direction of arrow 20 during its passage therethrough, at least partly counteracting any bending and/or flexing imparted by the archer as he releases bowstring 18.

After passage of arrow 20, rearward ends 44, 46 move apart as spring 50 recoils; forward ends 40, 42 return to their rest position (FIG. 4), ready to receive another arrow. The biasing force exerted by spring 50 maintains arms 36, 38 in the rest position. Thus, the passage of fletching 26 through arms 36, 38 and the restoring force of spring 50 result in a form of cam action: transmission of up-and-down, back-and-forth motion to forward ends 40, 42 and rearward ends 44, 46.

When installed on the user's bow, an arrow guide and holder according to the present invention simplifies locating the center-shot upon initial set-up of the bow, and can be used with virtually any type of arrow (including modem carbon and aluminum arrows). Arms 36, 38 hold arrow 20 securely while the bow is drawn or let down, helps maintain the arrow's direction when it is released, and can be disengaged while not in use. Arrow guide 10 as described above can be attached to the user's bow with any convenient type of mount. Furthermore, arrow guide 10 has no "handedness": it can be mounted on either left-handed or right-handed bows.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. An arrow guide and holder, comprising:

a pair of flexible, resilient, bendable arms;

means for holding said pair of arms in a rest position wherein said arms are spaced apart and offset from each other for gripping a shaft of an arrow therebetween, said pair of arms being movable from said rest position to permit passage of a fletching of said arrow therebetween; and spring means operably connected to said pair of arms, said spring means biasing said pair of arms towards said rest position.

2. The arrow guide and holder as recited in claim 1, wherein said arms are complementary in shape.

3. The arrow guide and holder as recited in claim 1, wherein each arm of said pair of arms has a forward end, and wherein said forward ends are formed for releasably gripping said shaft therebetween.

4. The arrow guide and holder as recited in claim 1, wherein each arm of said pair of arms has a rearward end, and wherein said spring means further comprises a coil spring connected between said rearward ends.

5. The arrow guide and holder as recited in claim 1, wherein each arm of said pair of arms is adjustable.

6. The arrow guide and holder as recited in claim 1, wherein each arm of said pair of arms has a forward end, and wherein each of said forward ends is at least partly covered by a jacket.

7. The arrow guide and holder as recited in claim 1, wherein each arm of said pair of arms has a rearward end, and wherein each of said rearward ends is at least partly covered by a jacket.

8. The arrow guide and holder as recited in claim 1, wherein said holding means further comprises a body having a pair of offset bores formed therethrough, each of said bores holding one of said arms therein.

9. An arrow guide and holder, comprising:

a body having a top, a bottom, a forward end, a rearward end, a left side, and a right side, said body having a first bore and a second bore formed therethrough, said first bore extending from said top near said forward end of said left side to said bottom near said forward end of said right side, said second bore extending from said top near said rearward end of said right side to said bottom near said rearward end of said left side, said bores being offset from each other;

first and second flexible, resilient, bendable arms, each of said arms having a forward end extending forwards of said body and a rearward end extending rearwards of said body, said first arm installed in said first bore and said second arm installed in said second bore; and a coil spring connected between said rearward ends, said coil spring biasing said arms towards a rest position.

10. The arrow guide and holder as recited in claim 9, wherein said first and second arms are complementary in shape.

11. The arrow guide and holder as recited in claim 9, wherein said forward ends are formed for releasably gripping a shaft of an arrow therebetween, said forward ends being movable from said rest position to permit free passage of a fletching of said arrow, said spring means restoring said arms towards said rest position following passage of said fletching.

12. The arrow guide and holder as recited in claim 9, wherein said first and second arms are adjustable.

13. The arrow guide and holder as recited in claim 9, wherein said forward ends are at least partly covered by jackets.

14. The arrow guide and holder as recited in claim 9, wherein said rearward ends are at least partly covered by jackets.

15. The arrow guide and holder as recited in claim 9, wherein said spring is adjustable.

16. The arrow guide and holder as recited in claim 9, wherein said arms are made of metal.

17. The arrow guide and holder as recited in claim 9, wherein said body portion is made of metal.

18. A method for making an arrow guide and holder, comprising:

forming a first bore in a body having a top, a bottom, a forward end, a rearward end, a left side, and a right side, said first bore extending from said top near said forward end of said left side to said bottom near said forward end of said right side;

forming a second bore in said body, said second bore extending from said bottom near said rearward end of said right side to said top near said rearward end of said left side, said first and second bores being offset from each other;

installing a first flexible, resilient, bendable arm in said first bore so that a forward end of said first arm extends forwards of said body and a rearward end of said first arm extends rearward of said body;

installing a second flexible, resilient, bendable arm in said second bore so that a forward end of said second arm extends forwards of said body and a rearward end of said second arm extends rearward of said body; and connecting said rearward ends of said first and second arms with a coil spring, said coil spring biasing said first and second arms to a rest position.

19. The method as recited in claim 18, wherein said first and second bores are formed in approximately parallel planes.

20. The method as recited in claim 18, further comprising the step of installing jackets on at least a portion of said first and second arms.

* * * * *